US005169266A

United States Patent [19]

Sala et al.

[11] Patent Number: 5,169,266

[45] Date of Patent: Dec. 8, 1992

[54] CORROSION RESISTANT STRUCTURE FOR SOIL REINFORCEMENT

[75] Inventors: Giuseppe Sala; Gaetano Ronchi; Pietro Pedeferri; Bruno Bazzoni; Luciano Lazzari, all of Milan, Italy

[73] Assignees: Sandvik Italia; Cesor Centro Studi Corrosione, both of Milan, Italy

[21] Appl. No.: 616,775

[22] Filed: Nov. 20, 1990

[30] Foreign Application Priority Data

Nov. 24, 1989 [IT] Italy ..... 22505 A/89

[51] Int. Cl.[5] ..... E02D 29/02

[52] U.S. Cl. ..... 405/262; 204/148; 204/197; 405/258; 405/284

[58] Field of Search ..... 405/284, 258, 262, 285, 405/286, 287; 204/197, 196, 148, 147

[56] References Cited

U.S. PATENT DOCUMENTS

| | | | |
|---|---|---|---|
| 3,201,335 | 8/1965 | MacNab et al. | 204/148 X |
| 3,484,350 | 12/1969 | Zavemski | 204/148 |
| 3,570,253 | 3/1971 | Yidal | 405/284 |
| 3,616,419 | 10/1971 | Bagnulo | 204/197 |
| 3,817,852 | 6/1974 | Toedtman et al. | 204/197 |
| 4,470,728 | 9/1984 | Broadbent | 405/284 |
| 4,496,444 | 1/1985 | Bagnulo | 204/148 |
| 4,685,838 | 8/1987 | Curt | 405/284 |

*Primary Examiner*—Dennis L. Taylor
*Attorney, Agent, or Firm*—Bucknam and Archer

[57] ABSTRACT

Method for the realization of soil reinforcement by means of cathodically polarized stainless steel units fearturing high corrosion resistance. The method applied foresees the use of stainless steel and carbon steel strips.

9 Claims, 1 Drawing Sheet

CORROSION RESISTANT STRUCTURE FOR SOIL REINFORCEMENT

The technique for soil reinforcement, invented by Henry Vidal and known as "Reinforced Earth" (a trade mark by Terre Armée Internationale S.A.), is used in the construction of supporting walls, railway embankments, sea-breakers, quays, dams, barriers, etc., and is obtained by sinking flat strips of metal into the ground during the construction so as to act as real structural units (H. Vidal, U.S. Pat. No. 3,421,326).

The method consists of combining a granular material, soil, with tensile resistant units, the reinforcement, so as to form a new composite building material. Owing to the adhesive forces between the reinforcement and the soil particles, this composite material can withstand very great loads, according to the reinforcement's resistance characteristics.

The metal presently used is nearly exclusively bare C-steel, or, preferably galvanized carbon steel, that is steel coated with a thick layer of zinc applied by hot dripping. This type of corrosion protection ensures durability up to 100 years, as is often required, as long as the soil used is not corrosive (J. M. Jailloux, "Durability of Materials in Soil Reinforcement Application", 9th European Congress on Corrosion, Utrecht 2-6 October 1989; M. Darbin et al, "Durability of Reinforced Earth Structures: the Results of a Long-term Study Conducted on Galvanized Steel", Proc. Instn. Civ. Engnrs, Part 1, 1988, Vol. 84, October, 1029-1057).

In this connection, considering that the project life can be limited only by the durability of the reinforcement, the design requirements specify the characteristics the soil used must comply with (M. Macori et al., "Durabilità delle Opere d'Arte Stradali", ANAS, Direzione Generale, Roma February 1988), namely:

resistivity above 1000 ohm/cm (M. Darbin et al, "Durability of Reinforced Earth Structures: the Results of a Long-term Study Conducted on Galvanized Steel", Proc. Instn. Civ. Engnrs, Part 1, 1988, Vol. 84, October, 1029-1057), or 3000 ohm/cm (M. Macori et al., "Durabilità delle Opere d'Arte Stradali", ANAS, Direzione Generale, Roma February 1988).

residual water pH between 5 and 10 chloride content - less than 200 mg.kg−1 sulphate content - less than 1000 mg.kg−1 total sulphides expressed as sulphur concentration: less than 300 mg.kg−1 no clays no organic substances.

The need to use soils with well defined characteristics that can ensure negligible corrosion of the metal reinforcement represents a meaningful economic burden, especially where soils with the features required are not available.

Also, in some cases, although one has used a "specific" soil free of corrosive materials, the external environment may, in time, after these characteristics, polluting the soils with chloride salts for example, as is common in coastal areas or, on roads as a result of the use of de-icing salts. Other environmental pollution phenomena such as "acid rain" make the problem even more complex. The results are a progressive increase of the soils corrosivity that in more or less long periods can cause the corrosion of the reinforcement thus affecting the mechanical resistance of the entire structure.

For example a striking case (G. E. Blight, M. S. Dane, "Deterioration of a Wall Complex Constructed of Reinforced Earth", Geotechnique, vol. 39, n. 1, pp. 47-53, 1989) which occurred only 18 months after completion describes the corrosion of zinc-coated steel reinforcement in Reinforced earth. The corrosive attack, which was first recognized as localized corrosion, caused the progressive deterioration of the structures, which led to its being demolished and rebuilt after only 8 years. Corrosion was caused by a striking aggressiveness of the soil; in fact, owing to the difficulty of locally acquiring soil with the features normally required, a less strict requirement was accepted with a durability of the structure limited to thirty years only and the following limits for the soil: pH 5-10; resistivity above 500 ohm/cm; chlorides less than 1500 mg.kg−1; sulphates less than 800 mg.kg−1; the use of sea water to compact the soil. In these conditions, added to the presence of clays and sands that formed differential aereation cells, localized corrosion phenomena took place rapidly.

Even the cathode protection method normally used in corrosion prevention for steels placed in soil, sea-water, concrete etc. is not easily applicable for a number of technical and economic reasons, amongst which:

the difficulty in realizing electric contact between the steel reinforcements to be protected and the anodes, both of the sacrificial or of the impressed current type;

the excess in consumption of traditional sacrificial type anodes (practically only the magnesium type) relative to the need for the carbon steels to reach immunity: this condition, for bare surfaces, that is non coated, signifies high protection current density and thus heavy consumption also related to the extremely protracted project lives, for example 100 years, required for these structures.

difficulty in access in case of replacement of exhausted anodes;

difficulties in current and potential distribution on the cathode structure, that is the reinforcement strips which in the earth make up a tight and geometrically complex network, (especially in the case of cathode protection by means of impressed current).

In the past, to solve the corrosion problem, metal materials instead of zinc coated carbon steel have been tried. So stainless steels featuring a chromium content equal to, or above 12%, were tried, but were definitely unsuccessful (J. M. Jailloux, "Durability of Materials in Soil Reinforcement Application", 9th European Congress on Corrosion, Utrecht 2-6 October 1989; M. Darbin et al, "Durability of Reinforced Earth Structures: the Results of a Long-term Study Conducted on Galvanized Steel", Proc. Instn. Civ. Engnrs, Part 1, 1988, Vol. 84, October, 1029-1057). In fact these materials which normally operate in so-called "passive" conditions, that is covered by a protective chromium oxide film, are subject to localized corrosion, especially by chloride ions, and secondly, by sulphate reducing bacteria. This situation can be further worsened by the presence of clays that feature poor oxygen transport, thus favouring the formation of active-passive macrocells.

This type of localized corrosion dramatically reduces the mechanical resistance of the metal unit, and, paradoxically, the damages may well be worse than those produced by a generalized corrosion attack, as is normal with zinc coated carbon steel. Therefore the use of stainless steels was quickly abandoned.

The use of polymer materials is also being studied; however their use requires a great number of tests and studies especially concerning their long term stability.

For all the above reasons corrosion of reinforcement structures represents a considerable problem in terms of the requirements of soil characteristics, and in any case represents a risk during the operative life owing to the possible changes of the soil's aggressivity.

The crux of the present invention resides in utilizing stainless steel appropriately cathodically polarized.

It is a known fact that cathodic polarization prevents the initiation of localized corrosion, keeping the stainless steel in so called "perfect passivity conditions", that is, stable both in relation to localized corrosion and generalized corrosion (P. Pedeferri, "Corrosione e Protezione dei Materiali Metallici", CLUP, Milano 1978; L. Lazzari, P. Pedeferri, "Protezione Catodica", CLUP, Milano, 1981).

The invention is illustrated by reference to the accompanying drawings of which:

Figure 1:
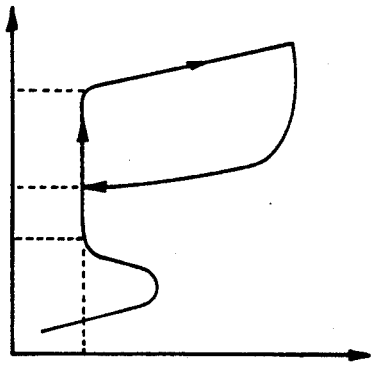
FIG. 1 illustrates the passivation potential, the pitting potential, the protection potential of stainless steel on the ordinate while the log of the current density is plotted on the abscissa.

In order to examine the corrosion performance of stainless steels one should bear in mind the so called "anode characteristic" of the material, and the parameters known as passivation potential—Ep, pitting potential—Er, and the protection potential—Epp. FIG. 1 shows on potentials—logarithm of the current density diagram, the typical anodic characteristic of a stainless steel in an environment such as sea-water or an aggressive soil. The figure clearly shows how when the natural potential falls within the Er-Ep interval the material operates in passive conditions, that is, the current associated to the anodic process is very low, equal to ip, and the corrosion rate is negligible. On the other hand, when the natural potential has values above those of the pitting potential, Er, the material is subject to pitting localized corrosion. Within the potential interval between Er and Ep also the potentials above and below Epp are made evident, the latter is known as perfect passivity or pitting protection potential.

Within the potential interval between Er and Epp the material is in conditions of "imperfect passivity": there are risks of localized corrosion, and above all, once these have begun they will spread and make repassivation impossible; below Epp on the contrary there are conditions of "perfect passivity" and thus no possibility of localized corrosion. The Er, Ep and Epp parameters are obviously characteristic of the type of stainless steel and the environment in which it is employed.

According to the above the polarization of the metallic materials in the cathodic direction, and more precisely from the potential of "free corrosion" to that of a potential below Epp, in perfect passivity, eliminates all risks of corrosion.

If we refer to sea-water, that can most certainly be conservatively compared to a highly corrosive soil, the object is to bring the potential of the more common stainless steels (austenitic, martensitic, ferritic, precipitation hardening, austeno-ferritic, etc.) to values around −0.200−−0.500 V vs $Cu/CuSO_4$ saturated reference electrode. A more accurate definition of the pitting protection potential depends on the type of stainless steel and the type of soil; in any case we remain in polarization conditions which are considerably lower than those needed for the protection of carbon steels (−0.850 V vs $Cu/CuSO_4$) saturated.

In these conditions we can certainly state that stainless steel features the required characteristics for use with all types of soil realistically to be encountered with Reinforced Earth, above all with soils with less strict corrosion requirements than those currently enforced and thus more easily found.

The invention, in its more general scope, consists therefore in Reinforced Earth structures, characterized by high corrosion resistance in the terms above described, where the armature is made up of cathodically polarized stainless steel strips.

The term stainless steels defines those iron-based alloys featuring the following composition expressed as a percentage of the alloying elements:

| | |
|---|---|
| chromium | 11-35% |
| nickel | 35% max |
| molybdenum | 7% max |
| copper | 3% max |
| aluminum | 1% max |
| titanium | 1% max |
| niobium | 1% max |
| tungsten | .5% max |
| carbon | .5% max |
| sulphur | .05% max |
| phosphorus | .05% max |
| silicon | 2.5% max |
| manganese | 3% max |
| nitrogen | .4% max |
| iron | balance |

The specific chemical composition of a given stainless steel and the heat treatment it undergoes defines the type of microstructure it shows: the following classes of stainless steel are considered, defined on the basis of their microstructures: martensitic, austenitic, ferritic, bi-phasic austeno-ferritic, superaustenitic, precipitation hardening.

Within each of these classes one can distinguish materials with different features depending on the heat treatment operations, and above all to hardening by cold working. (A. Cigada, G. Re "Metallurgia", Vol. II, CLUP, Milano 1984).

To obtain the required cathode polarization one can employ the so-called "impressed current" method, where the polarization is obtained by connecting an outside power system to the circuit made up by the reinforcement and by one or more anodes, for example of non consumable type, laid into the ground (L. Lazzari, P. Pedeferri, "Protezione Catodica", CLUP, Milano 1981.)

It is preferable to obtain the polarization according to the so-called "sacrificial anode" principle, where the power for polarization is provided by the battery formed by coupling the metal to be protected with another less electrochemically noble metal.

One material which can be specifically used as sacrificial anodes, apart from the traditional aluminum, zinc, and magnesium, is carbon steel. The latter features in the soil a spontaneous potential in the −0.400−−0.600

V range vs $Cu/CuSO_4$. The specific advantage represented by carbon steels is that its natural potential is close to that of stainless steels, and therefore the protection effect is reached within the terms required without an excessive consumption of anodic material.

In these conditions the carbon steel takes on an anodic behaviour and the stainless steel acts as a cathode: the effect is the production of a low current short circuit current which corresponds on the electrode surfaces to the reduction of oxygen on the cathode (stainless steel), and an anodic dissolution of the carbon steel strip. In the soil the circulation of the current is supported by the migration of ion species dissolved in water: positive charged ions shall migrate towards the cathode and those negatively charged towards the anode. This last aspect plays a particularly important role in maintaining the steel anode surfaces active: in fact the chloride ions, that concentrate close to the anode surfaces, help prevent passivation of the iron, which might reduce or cancel the difference in potential with the stainless steel.

The quality of the stainless steel chosen for a specific structure, and the device for cathodic polarization, both determine the level of corrosion resistance and thus the overall reliability of the system. One can state that given the same polarization conditions the risks of a localized corrosion attack will be all the lower the higher the pitting potential of the stainless steel. In this sense stainless steels may be classified according to the "Pitting Resistance Equivalent" parameter, defined on the basis of the chromium, molybdenum and nitrogen content (P. Wilhelmsson et al., "Sandvik SAF 2304 - A High Strength Stainless Steel for the Engineering and Construction Industries", A. B. Sandvik Steel, R&D Centre): that is:

$$P.R.E. = Cr\ \% + 3.3Mo\ \% + 16N\ \%$$

In a preferred realization the invention consists of a reinforcement for earth made up of a bi-metallic strip consisting of stainless steel strip of the austeno-ferritic type and a carbon steel strip. From a mechanical resistance point of view the entire load will be borne by the stainless steel strip, and this must be considered in calculating width and thickness of the stainless steel strip. Whereas the thickness of the carbon steel only has an electrochemical function as a sacrificial anode; its size therefore shall respond to durability requirements according to the design life planned.

These bi-metallic elements (stainless steel and carbon steel strips) can be produced by co-lamination, spot welding or continuous welding between the two metals, or with any other suitable method so as to ensure electric contact between the two metals.

The finished product may also be completed by cross bars and heading so as to increase its adherence to the soil.

This realization offers the specific advantage of solving the difficulties in electrically connecting the anodes, whether these are of the sacrificial type or those with impressed current, thus ensuring uniform distribution of the current and the potential throughout the reinforcement.

In a similar realization of the bi-metallic element, the cathodic surface, that is the external surface—soil side—of the stainless steel element is painted. Paint application, as proposed here, is not foreseen for anti-corrosion purposes, as is traditional, but it is specifically recommended in order to reduce areas to be cathodically protected and, consequently, to reduce the average galvanic, i.e. protection, current. This means lower consumption of the sacrificial carbon steel strip, thus allowing to limit relevant sizes and weights. Obviously design shall be based on a linear coating break-down, to take into account the loss of paint effectiveness in time.

The term paint here defines paints in general as well as all types of non metallic coating and lining suitable for application on the stainless steel strip. As for the metal fittings of the strips to the concrete face; bolts, nuts or brackets; these can remain as designed and need no modifications. As for the materials they can be manufactured according to traditional techniques, that is, in galvanized carbon steel, or, in case of particularly aggressive environments, also in stainless steel, preferably of the austeno-ferritic type. In this case, the brackets can also be made in bimetallic material.

Figure 2:
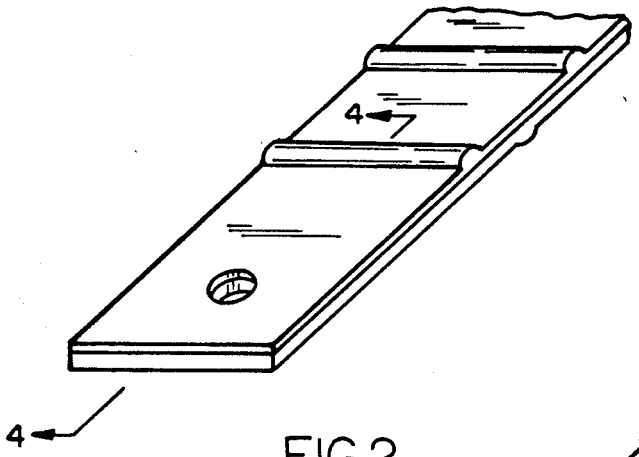
FIG. 2 illustrates one embodiment of the steel strip of the invention made of a stainless steel strip and a carbon steel strip.

The invention is illustrated at FIG. 2 in one of its possible forms of realization, where the bimetallic reinforcement is made up of stainless steel strip (1), thickness S1, and of colaminated carbon steel strip (2), thickness S2; the reinforcement is then completed by a number of cross bars (3), which increase the adherence to the soil; the holes (4), at the end of the strips are for anchorage to the face.

Figure 3:
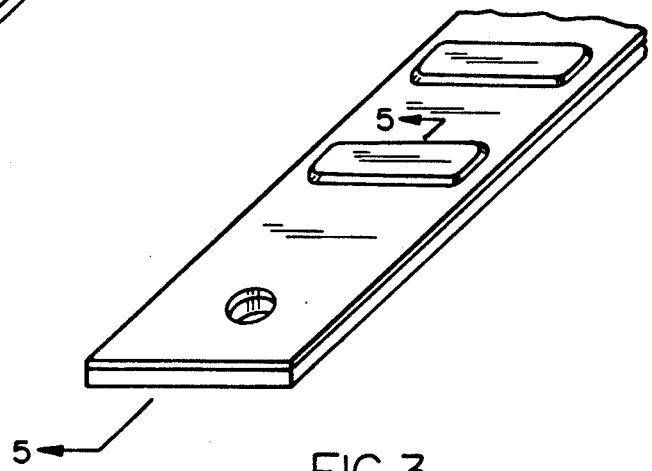
FIG. 3 illustrates another embodiment of the invention according to which the two strips are assembled by spot welding.
Figure 4:
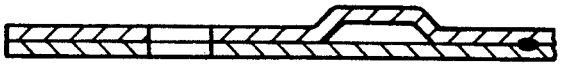
FIGS. 4 and 5 are views taken along lines A—A of FIGS. 2 and 3, respectively.
Figure 5:
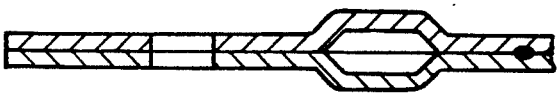

A second embodiment is shown in FIG. 3, where the two stainless steel and carbon steel components are assembled by means of spot welding (5) (the other numbers show the same points as FIG. 2).

In FIG. 3, to increase the adhesion between soil and reinforcement the headed zones (6), were added, their thickness is S3.

EXAMPLE 1

The case refers to the construction of a coastal barrier with Reinforced Earth, exposed to a typical sea climate and thus subjected to contamination of the soil by chloride salts.

The traditional project featured carbon steel strips, hot zinc coated, width 50 mm and thickness 6 mm. Out of the overall thickness, 3 mm represented the added thickness for corrosion allowances, while the remaining 3 mm were needed for the applied load in consideration of the fact that the yield strength (Rp 0.2) for the carbon steel being examined is 240 $N.mm^{-2}$ min. From the dimensions of the working section and the yield strength the mechanical resistance calculated for the strips is 36.000N.

To ensure corrosion resistance for the entire project life, 100 years, the structure was produced with reinforcement made up by bi-metallic strip units made of Sandvik SAF 2304 (deposited trademark of A.B. Sandvik Steel, Sweden) in annealed conditions and carbon steel. The SAF 2304 (P. Wilhelmsson et al., "Sandvik SAF 2304 - A High Strength Stainless Steel for the Engineering and Construction Industries", A.B. Sandvik Steel, R&D Centre) stainless steel features a higher resistance to localized corrosion than the traditional types AISI 304L and 316L (P.R.E. equal to 24.6 for SAF 2304, 24.3 for AISI 316L and 18.4 for AISI 304L).

The mechanical resistance of the element is ensured by the stainless steel strip that features a yielding strength (Rp 0.2) at least (Rp 0.2) 400 $N.mm^{-2}$. To ensure a tensile resistance to that calculated for the galvanized carbon steel structure, a section 60 mm wide and 1.5 mm thick was chosen. The carbon steel unit, acting as a sacrificial anode is 3 mm thick and is spot welded every 500 mm.

The size of the carbon steel unit was chosen assuming that the protection current density would be 10 $mA.m^{-2}$ as the anode consumption of 10 $g.mA^{-1}.year^{-1}$; the consumption of carbon steel is calculated on the basis that the project's current density will be used for the reduction of oxygen on the stainless steel surface, on one side, and on the carbon steel, on one side, (current possibly absorbed by the two metal surfaces facing each other was considered insignificant, because in the gap local oxygen transportation will be considerably hindered).

The bi-metallic reinforcements realized as described where checked one year after installation and featured a uniform corrosion rate on the earth-side steel, equal to 15 microns; whereas the stainless steel unit showed no corrosion at all, neither generalized nor localized.

We claim:

1. A metal structure for reinforcing soil consisting of a bimetallic strip, said bimetallic strip being constituted by a reinforcing unit (1) of stainless steel contacted with a unit (2) of a less electrochemically noble metal which acts as a sacrificial anode, wherein said less electrochemically noble metal is carbon steel and wherein said reinforcing unit (1) of stainless steel is an alloy which is a member selected from the group consisting of martensitic, austenitic, ferritic, bi-phasic austeno-ferritic, superaustenitic steel in annealed or in cold hardened condition, the main components of the alloy being:

| | |
|---|---|
| chromium | 11-35% |
| nickel | 35% max. |
| molybdenum | 7% max. |
| copper | 3% max. |
| aluminum | 1% max. |
| titanium | 1% max. |

-continued

| | |
|---|---|
| niobium | 1% max. |
| tungsten | .5% max. |
| carbon | .5% max. |
| sulpher | .05% max. |
| phosphorus | .05% max. |
| silicon | 2.5% max. |
| manganese | 3% max. |
| nitrogen | .4% max. |
| iron | balance |

2. The structure according to claim 1 wherein said reinforcing unit (1) acts as a cathode and is coated with a non-metallic coating in order to reduce protection current requirements and sacrificial anode consumption.

3. The structure according to claim 1 wherein said unit (1) of stainless steel is contacted with said unit (2) which acts as a sacrificial anode by colamination.

4. The structure according to claim 1 wherein said unit (1) of stainless steel is contacted with said unit (2) which acts as a sacrificial anode by welding at distances between 50 and 2000 mm.

5. The structure according to claim 1 wherein said bimetallic strip is provided with cross bars (3) to increase adherence of said structure to the soil.

6. The structure according to claim 1 wherein said bimetallic strip is provided with headed areas (6) to increase the adherence of the structure to the soil.

7. The structure according to claim 1 wherein said bimetallic strip is anchored to concrete and has at least one hole (4) for anchorage to said concrete.

8. The structure according to claim 1 wherein said anchorage is achieved by means of metal fittings.

9. The structure according to claim 1 wherein said stainless steel has a yield strength of at least 400 $N.mm^2$ and said carbon steel is 3 mm thick.

* * * * *